US009591885B2

(12) United States Patent
Cheng

(10) Patent No.: US 9,591,885 B2
(45) Date of Patent: Mar. 14, 2017

(54) BICYCLE HELMET WITH VISOR

(71) Applicant: Strategic Sports LLC, Hong Kong (HK)

(72) Inventor: Tien Hou Cheng, Hong Kong (HK)

(73) Assignee: Strategic Sports LLC, Pok Fu Lam, Hong Kong (CN)

( * ) Notice: Subject to any disclaimer, the term of this patent is extended or adjusted under 35 U.S.C. 154(b) by 680 days.

(21) Appl. No.: 13/854,960

(22) Filed: Apr. 2, 2013

(65) Prior Publication Data

US 2014/0189939 A1 Jul. 10, 2014

(30) Foreign Application Priority Data

Jan. 7, 2013 (HK) ..... 13100213.6

(51) Int. Cl.
*A42B 3/22* (2006.01)

(52) U.S. Cl.
CPC ..... *A42B 3/223* (2013.01); *A42B 3/227* (2013.01)

(58) Field of Classification Search
CPC ..... A42B 3/223; A42B 3/227; A42B 3/22; A42B 3/222; A42B 3/066; A42B 3/069; A42B 3/221; A42B 3/0406
USPC ..... 2/6.5, 425, 422, 12
See application file for complete search history.

(56) References Cited

U.S. PATENT DOCUMENTS 4,305,160 A * 12/1981 Sundahl ..... A42B 3/222 16/334
4,807,305 A * 2/1989 Sundahl ..... A42B 3/223 2/424
4,970,729 A * 11/1990 Shimazaki ..... A42B 3/281 2/181.2
4,985,938 A * 1/1991 Snow, Jr. ..... A42B 3/20 2/424
5,005,221 A * 4/1991 Chen ..... A42B 3/222 2/424
5,073,990 A * 12/1991 Kamata ..... A42B 3/222 2/424
5,091,997 A * 3/1992 Foehl ..... A42B 3/222 2/424

(Continued)

FOREIGN PATENT DOCUMENTS

DE 9401066 U1 * 3/1994 ..... A42B 3/227
EP 0619956 A1 * 10/1994 ..... A42B 3/227

*Primary Examiner* — Amy Vanatta

(74) *Attorney, Agent, or Firm* — Wood Herron & Evans LLP

(57) ABSTRACT

An improved bicycle helmet includes an inner layer having a concave shape, an outer layer having a convex shape, and a sun visor. The outer layer covers the inner layer and includes an outer layer attachment member and an outer layer lock member. The sun visor includes a shade member and a sun visor attachment member connected to and distal to the shade member. The sun visor attachment member is adapted to rotatably engage with the outer layer attachment member to form a fulcrum. The sun visor lock member is adapted to operatively engage the outer layer lock member so as to releasably lock the sun visor into a fixed position. The sun visor lock member and the outer layer lock member operatively engage so as to allow the sun visor to be releasably locked into one of a plurality of fixed positions. the sun visor attachment member and the outer layer attachment member rotatably engage via a snap fit fastener.

20 Claims, 4 Drawing Sheets

(56) References Cited

U.S. PATENT DOCUMENTS

| | | | | | |
|---|---|---|---|---|---|
| 5,093,939 | A * | 3/1992 | Noyerie | A42B 3/326 | 2/424 |
| 5,333,329 | A * | 8/1994 | Hong | A42B 3/222 | 2/424 |
| 5,517,698 | A * | 5/1996 | Nault | A42B 3/066 | 2/424 |
| 5,621,923 | A * | 4/1997 | Tapocik | A42B 3/227 | 2/12 |
| 5,675,843 | A * | 10/1997 | Grim | A42B 3/227 | 2/12 |
| 5,901,369 | A * | 5/1999 | Pilney | A42B 3/22 | 2/422 |
| 6,009,561 | A * | 1/2000 | Bullock | A42B 3/227 | 2/12 |
| 6,009,562 | A * | 1/2000 | Bullock | A42B 3/16 | 2/12 |
| 7,814,579 | B2 * | 10/2010 | Dion | A42B 3/222 | 2/410 |
| 8,166,577 | B2 * | 5/2012 | Lee | A42B 3/222 | 2/15 |
| 2007/0074335 | A1 * | 4/2007 | Gafforio | A42B 3/223 | 2/410 |
| 2009/0000015 | A1 * | 1/2009 | Ahn | A42B 3/227 | 2/422 |
| 2011/0094019 | A1 * | 4/2011 | Isobe | A42B 3/222 | 2/424 |
| 2012/0284905 | A1 * | 11/2012 | Kim | A42B 3/226 | 2/424 |
| 2015/0082520 | A1 * | 3/2015 | Cheng | A42B 3/226 | 2/411 |

* cited by examiner

BICYCLE HELMET WITH VISOR

FIELD OF THE INVENTION

The present invention relates to the field of bicycle helmets. Specifically, the present invention relates to bicycle helmets having a sun visor.

BACKGROUND

Bicycle helmets are used for protecting a rider's head during, for example, a crash or a fall. Such helmets are typically formed by well known processes involving the use of a hollow mould into which an expandable material, such as a foam and/or a foam precursor is added. The mould is typically heated up prior to or during the process, and often a vacuum is applied to help expand the foam and/or foam precursor.

In-moulding, also known as injection-moulding and co-injection moulding, is well-known in the art of helmet making for combining a hard outer layer with an inner polystyrene shape. Processes are also known for adding a lacquered outer layer to a Styrofoam, polystyrene foam, or other foam helmet. Other processes are known for injecting a pre-mixture of, for example expandable poly styrene (EPS) beads and spongy particles into a mould together so as to allegedly produce a helmet with a balance between impact protection and impact absorption. In some cases expandable poly propylene (EPP) beads are used as well. Some processes apply different materials into the mould at the same time, while other processes first form the pieces separately and then affix them together afterwards.

Face shields are also well-known in full-face helmets, such as motorcycle/racing helmets and dirt bike helmets. In a racing helmet the face shield is typically formed of Plexiglas or other clear plastic and tends to cover the face, either partially or completely. Such a clear face shield is often required for safety and to meet various regulatory requirements. Face shields are often able to pivot up relative to the bicycle helmet so as to, for example, allow the user to clean condensation from the inside of the bicycle helmet without taking it off. However, such face shields are intended to be permanently affixed to the bicycle helmet as removing them may potentially cause safety issues during subsequent use.

In cases such as horse riding and BMX-biking, full-face helmets are sometimes used and these may have sun visors affixed thereupon. Such sun visors are opaque and shield the face from the sun much like the bill of a baseball cap. Such sun visors are typically permanently fixed to the bicycle helmet and are unmovable—i.e., they are not intended to be removed by the bicycle helmet user.

Recently, bicycle racing helmets have been developed which combine the face-shield in a racing helmet with an abbreviated face shield, for cases where the rider is riding into the sun. Such helmets are typically not full-face helmets, but instead only cover the crown of the head, and do not cover the ears, back of the neck, chin, etc. Such helmets are available from, for example, CRATONI® as the EVOLUTION. However, the shields of such helmets are like racing helmets, permanently affixed to the bicycle helmet and not intended to be removed by the user.

GIRO recently released the GIRO BELL XAR helmet having a "Point of View" (a.k.a., "POV") sun visor that pivots up to 15° and is intended for mountain biking, trail biking, endurance riders, etc. The POV sun visor (see, for example: http://www.youtube.com/watch?v=65AtDHnJI7k) allegedly has an internal clutch mechanism which fixes it in place. However, such a pivoting mechanism for an adjustable visor has certain drawbacks. For example, and as seen in the above video, when it is raised up, it may in some cases slowly fall down and otherwise fail to remain in a fixed position. This may be especially frustrating when the user travels over bumpy or uneven terrain which may make the POV visor undesirably move from the position that the user adjusted it to.

Accordingly, there remains a need for a bicycle helmet having a pivoting visor which is, for example, easily constructed in an efficient manner, has a removable or replaceable sun visor, and/or, stays in a relatively fixed position unless specifically adjusted by the user.

SUMMARY OF THE INVENTION

The present invention relates to an improved bicycle helmet includes an inner layer having a concave shape, an outer layer having a convex shape, and a sun visor. The outer layer covers the inner layer and includes an outer layer attachment member and an outer layer lock member. The sun visor includes a shade member and a sun visor attachment member connected to and distal to the shade member. The sun visor attachment member is adapted to rotatably engage with the outer layer attachment member to form a fulcrum. The sun visor lock member is adapted to operatively engage the outer layer lock member so as to releasably lock the sun visor into a fixed position. The sun visor lock member and the outer layer lock member operatively engage so as to allow the sun visor to be releasably locked into one of a plurality of fixed positions. The sun visor attachment member and the outer layer attachment member rotatably engage via a snap fit fastener.

Without intending to be limited by theory, it is believed that the improved helmet herein may provide one or more benefits over the prior art helmets having adjustable sun visors. For example, the improved helmet herein may provide an improved attachment member and lock member system which allows easy production and easy adjustment of the sun visor to a plurality of different angles, in a fixed manner. The system herein also allows the sun visor to be fixed in a manner which prevents undesired slippage of the sun visor unless the sun visor is manually adjusted by the user.

The figures herein are for illustrative purposes only and not necessarily drawn to scale.

DESCRIPTION OF THE PREFERRED EMBODIMENTS

Unless otherwise specifically provided, all tests herein are conducted at standard conditions which include a room and testing temperature of 25° C., sea level (1 atm.) pressure, pH 7, as appropriate, and all measurements are made in metric units. Furthermore, all percentages, ratios, etc. herein are by weight, unless specifically indicated otherwise.

An improved bicycle helmet includes an inner layer having a concave shape, an outer layer having a convex shape, and a sun visor. The outer layer covers the inner layer and includes an outer layer attachment member and an outer layer lock member. The sun visor contains a shade member, a sun visor attachment member and a sun visor lock member. The sun visor attachment member is connected to and distal from the shade member and is adapted to rotatably engage with the outer layer attachment member to form a fulcrum. The sun visor lock member is adapted to operatively engage to the outer layer lock member so as to releasably lock the sun visor into a fixed position. The sun visor lock member and the outer layer lock member operatively engage so as to allow the sun visor to be releasably locked into one of a plurality of fixed positions. The sun visor attachment member and the outer layer attachment member rotatably engage via a snap fit fastener.

Figure 1:
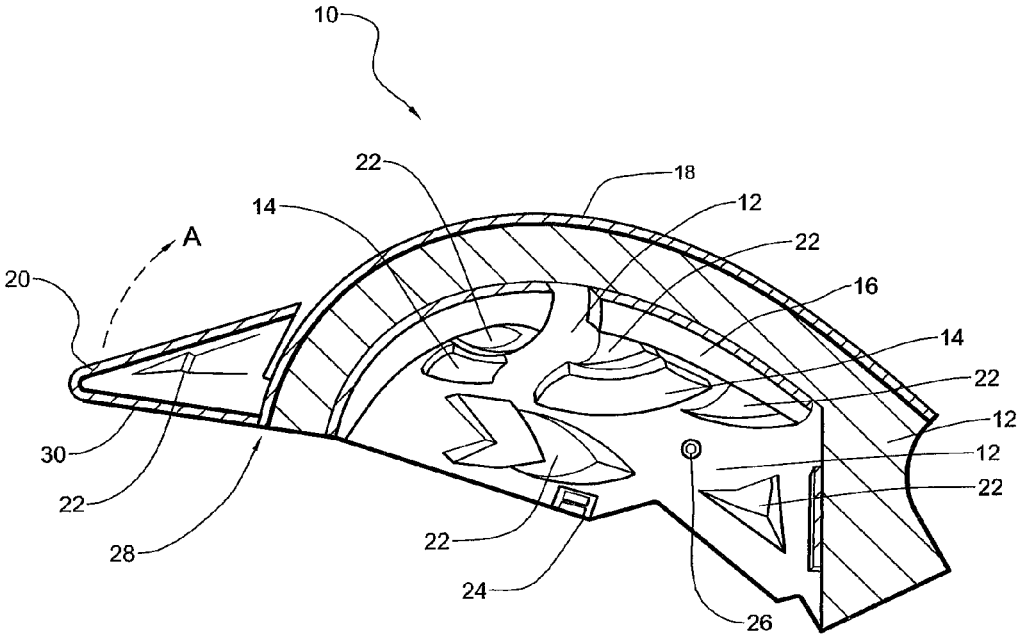
FIG. 1 shows a side cut-away view of an embodiment of an improved bicycle helmet.

FIG. 1 shows a cut-away side view of an embodiment of the improved bicycle helmet, 10, herein. The bicycle helmet, 10, has an inner layer, 12, having a convex shape. The convex shape of the inner layer ergonomically fits a user's head so as to comfortably protect the user. The inner layer, 12, is typically selected from one or more layers; or from about 1 to about 10 layers; or from about 2 layers to about 5 layers of an impact absorbing and/or impact dissipating material such as, for example, a polystyrene, a polypropylene, paper, a resin, and a mixture thereof; or from an extruded polystyrene, an expanded polystyrene; expanded polypropylene, cardboard, and a mixture thereof; or an expanded polystyrene, corrugated cardboard, and a mixture thereof. Without intending to be limited by theory, we believe that these materials provide a good balance between factors such as cost, weight, durability, impact-dissipation, formability, stability across various temperature ranges, etc. Expanded polystyrene especially tends to be light and also able to withstand both high and low temperature extremes and maintain its physical shock-absorbing properties for use in, for example, skiing helmets as well as water sport helmets.

In an embodiment herein, the inner layer may contain and/or be formed of cardboard; or corrugated cardboard, such as found in the Kranium helmet designed by Anirudha Rao (a.k.a., Anirudha Surabhi; see, for example: http://www.geek.com/articles/geek-cetera/kranium-a-cardboard-helmet-thats-safer-than-plastic-2011068/) which combines corrugated cardboard with other impact-absorbing and ergonomic materials.

The inner-layer, 12, may include a comfort-enhancing member, 14. The comfort-enhancing member typically touches the user's head in one or more places and may be, for example, a pad, a cushion, a depression, etc. In FIG. 1, the comfort-enhancing member is a pad, 16, that is integral to the inner layer, 12. Such an integral comfort-enhancing member may be formed by, for example, in-moulding the comfort-enhancing member with the inner layer, or may be attached with, for example, an adhesive. In another embodiment the comfort-enhancing member may be removably attached to the inner layer, with, for example, a removable and/or a low-strength adhesive, a hook-and-loop fastener such as Velcro®, by employing a key-and-lock type fastener, a removable snap fit fastener, or other methods known in the art. Such a removable comfort-enhancing member may be desirable to enable washing, replacement, etc. of the comfort-enhancing member. Such fasteners and adhesives are well-known in the art and available from multiple suppliers world-wide.

In an embodiment the comfort-enhancing member is in the form of a depression which is specifically formed to accommodate a portion of the user's head, such as, for example the ears, or a portion of the head. In some cases, where, for example, the intended user has a more angular head shape as compared to a rounder or oval head shape, such a depression; or multiple depressions; may provide a significantly improved fit and/or comfort.

The comfort-enhancing member may be formed of any useful material known in the art, such as, for example, a plastic, rubber, a foam, cloth, and a combination thereof; or a memory foam, cloth, a porous plastic, rubber and a combination thereof; or a memory foam, cloth, and a combination thereof. Without intending to be limited by theory, it is believed that a memory foam provides improved comfort to the user, while a cloth or a porous plastic provides sweat wicking and breathability properties that enhance the comfort of the user. In an embodiment herein the comfort-enhancing member is inflated with a gas such as air or an inert gas.

In an embodiment herein the comfort-enhancing member may also serve to reduce the amount of impact force transmitted to the user's head and body. Such an impact force reduction may be due to, for example absorption or dissipation of at least a portion of the impact force.

FIG. 1 also shows that the bicycle helmet, 10, contains an outer layer, 18, covering the inner layer, 12. The outer layer, 18, has a convex shape when viewed from the outside of the bicycle helmet. The outer layer covers at least partially, and typically most, if not all of the inner layer. While typically quite thin, the outer layer may be permanently bound to the inner layer during an in-moulding process. In an alternate embodiment, the inner layer may be removably attached to the outer layer via a variety of fasteners and/or adhesives, such as described above for removably attaching the comfort-enhancing member.

The outer layer, 18, serves multiple purposes such as aesthetics, additional impact dissipation, friction reduction, etc. For example, the outer layer may have various pigments, patterns, ornamentation, and/or textures thereupon or included therein, including those recognizable as designs, logos, etc. In an embodiment herein, the outer layer is a hard, relatively brittle material such as, for example, acrylonitrile butadiene styrene, and/or polycarbonate, which is intended to shatter upon impact so as to further dissipate the impact of a collision. In theory, such a shattering of the outer layer propagates the impact force in a lateral direction, so as to reduce the force transmitted inwardly through the helmet to the inner layer and therefore to the user. A shattered outer layer after an impact may also be an indication that the impact was great enough that the structural integrity of the bicycle helmet may have been compromised, and therefore may serve as an indication that the bicycle helmet should be replaced with a new helmet and/or repaired. Without intending to be limited by theory, it is believed that this may reduce the chance that a helmet with compromised structural integrity is further used so as to result in an avoidable injury.

In an embodiment herein the outer layer contains an outer layer material selected from a polycarbonate, a polystyrene, a polyacrylate and a mixture thereof; or from acrylonitrile butadiene styrene, an extruded polystyrene, an expanded polystyrene, and a mixture thereof; or acrylonitrile butadiene styrene, an expanded polystyrene and a mixture thereof.

In an embodiment herein, the outer layer includes a friction-reducing material selected from polytetraflouroethylene, perfluoroalkoxy, fluorinated ethylene propylene, aluminium magnesium boride, nylon, an acetal, an ultra high molecular weight polyethylene, and a mixture thereof. Such a friction-reducing material may be, for example, coated onto the outer layer or may be mixed into the outer layer material during the moulding process or even earlier in the process, as desired by one skilled in the art.

Methods for forming and manufacturing a bicycle helmet containing an inner layer and outer layer are well known in the art and typically include providing a female mould portion, providing a male mould portion, providing an impact-dissipating material, providing the outer layer material, and optionally providing any separately-made comfort-enhancing members. The female mould portion is complementary to the male mould portion and therefore the female mould portion and the male mould portion are able to be fit together so that they form a hollow mould therebetween. The relevant materials and parts are then added into the mould in the proper order and under the proper conditions to form a helmet. Additional modifications may be further made after the moulding process, such as adding ornamentation, decorations, optional comfort-enhancing materials, logos, etc.

FIG. 1 also shows that the bicycle helmet, 10, includes a sun visor, 20, associated therewith. The sun visor, 20, is adjustable to a plurality of fixed positions; or from about 2 fixed positions to about 6 fixed positions; or from about 3 fixed positions to about 4 fixed positions. As used herein, the term "fixed position" indicates a position to which the user may manually adjust the sun visor (i.e., by rotating) without the need for any tools. Usually such an adjustment occurs by hand and employs a predetermined amount of force. This predetermined amount of force indicates that the fixed position is provided such that typical use will not dislodge the sun visor from its fixed position, even when mild bumping, vertical vibrations, etc. occur. As such, the resistance between each fixed position is sufficient to allow manual adjustment of the sun visor between the fixed positions, while avoiding accidental or unwanted adjusting of the sun visor during even, for example, normal off-road use. Such a plurality of fixed positions into which the lock mechanism (and therefore the sun visor) are releasably locked provides a significant increase in usability as compared to the prior art adjustable visors which require either tools (i.e., a screwdriver or Allen Wrench) to adjust the visor, or which may undesirably fall by themselves, or when a normal in-use vibration (such as hitting a normal bump, nodding one's head, etc.) initiates the unwanted adjustment.

Without intending to be limited by theory it is believed that these fixed positions provide a sufficient number of fixed positions to accommodate the user's needs, while reducing potential confusion by the user when there are too many fixed positions. Such a limited number of fixed positions may also reduce manufacturing complexity, as well as the amount of raw materials needed to form the respective lock members.

In FIG. 1, the sun visor, 20, is in a lowered position (rotated down), with respect to the helmet, 10. Without intending to be limited by theory, the applicant believes that the sun visor, 20, of the bicycle helmet, 10, typically needs to only be slightly adjusted so as to avoid the sun and to provide appropriate shade to the bicycle helmet user. In some cases, the user may want to move the sun visor to only a few fixed positions, rather than through an infinite possibility of minor angle changes. Thus, in an embodiment herein the angle between the plurality of fixed positions is a standard angle (see FIG. 6, at $\alpha_1$, $\alpha_2$, $\alpha_3$, $\alpha_4$); or the standard angle is from about 2° to about 15°; or the standard angle is from about 3° to about 10°; or the standard angle is from about 4° to about 7°.

The visor, 20, also may contain a vent, 22, for passing air, heat, etc. therethrough. When the vent, 22, is on the sun visor, 20, the vent, 20, must be design such that the vent does not allow a significant amount of sunlight through so as to strike the user's eyes. Accordingly, such a vent, 22, in the sun visor, 20, is typically angled or otherwise designed to defeat the purpose of the sun visor, 20. In an embodiment herein the sun visor contains from about 1 vent to about 6 vents; or from about 2 vents to about 4 vents.

The bicycle helmet, 10, of FIG. 1 also contains a plurality of vents, 22, that pass through both the inner layer, 12, and the outer layer, 18. These vents, 22, may provide a variety of benefits to the user, for example, improved ventilation, additional impact dissipation, reduced helmet weight, reduced need for helmet raw materials such as the impact absorbing material, impact dissipating material, and/or the outer layer material.

The bicycle helmet, 10, and the inner layer, 12, also may include additional items such as, for example, a chin strap tab, 24, ear holes (not shown), accessory attachment points, 26, integrally moulded therein, permanently affixed thereto, or removably affixed thereto. The accessory attachment points, 26, may allow, for example, a Bluetooth earphone to be affixed to the bicycle helmet, 10, to allow hands-free communication with others while riding a bicycle.

In FIG. 1, the sun visor, 20, is rotated down, meaning that the sun visor, 20, is as close to the user's face as possible. While the sun visor, 20, is releasably locked in this rotated down position, the user may freely rotate the sun visor, 20, upwards, as shown by an arrow, A, to a plurality of fixed positions as described herein. The helmet, 10, is worn so that the user's face is pointed towards a front edge, 28, of the helmet, 10. The front edge, 28, is typically right above and in front of the user's forehead. In FIG. 1, a lower edge, 30, of the sun visor, 22, is substantially planar with the bottom of the helmet, 10, as judged at the front edge, 28, of the helmet, 10.

Figure 2:
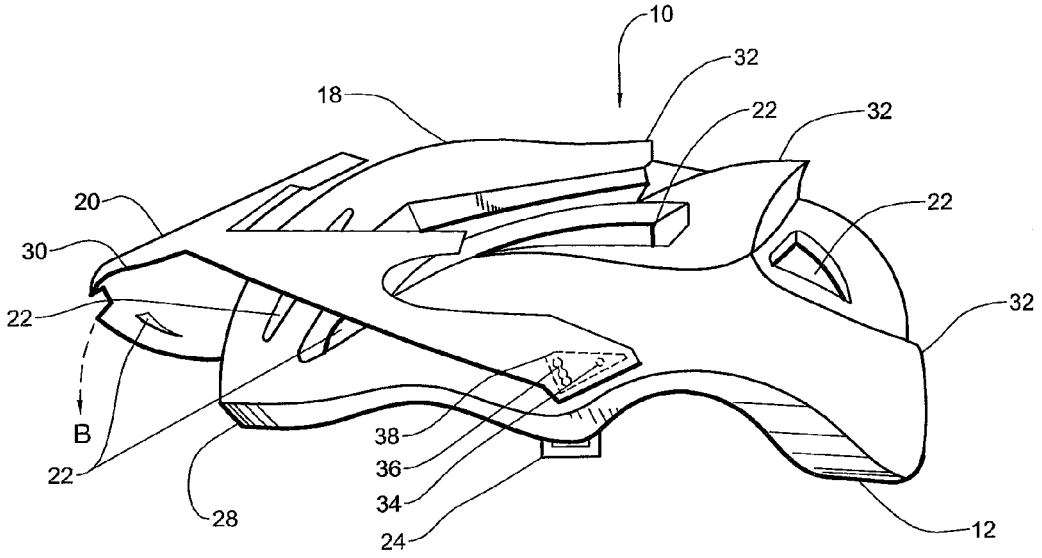
FIG. 2 shows a side view of an embodiment of a bicycle helmet of the present invention with a visor rotated up.

FIG. 2, shows a side view of an embodiment of a bicycle helmet, 10, of the present invention with a visor, 20, rotated up, meaning that the sun visor, 20, is farther away from the front edge, 28, and therefore farther away from the user's face than when it is rotated down. As such, it can be seen that the lower edge, 30, is substantially higher up than in, for example, FIG. 1. Thus, while the sun visor, 20, is releasably locked in this rotated up position, the user may freely rotate the sun visor, 20, downwards, as shown by an arrow, B, to a plurality of fixed positions as described herein.

FIG. 2 also shows the outer layer, 18, having various contoured shapes, 32, which may be present for the purposes of ornamentation, air drag reduction/aerodynamics, ventilation, etc. Such contoured shapes may also surround the vents, 22, so as to help direct airflow within the helmet to improve ventilation within the helmet, 10. As shown by the dotted lines, an outer layer attachment member, 34, and an outer layer lock member, 36, are combined into a housing, 38. The housing, 38, outer layer attachment member, 34, and outer layer lock member, 36, are indicated in dotted-lines as they are located below the visor, 20, and are actually not visible in the view shown in FIG. 2.

Figure 3:
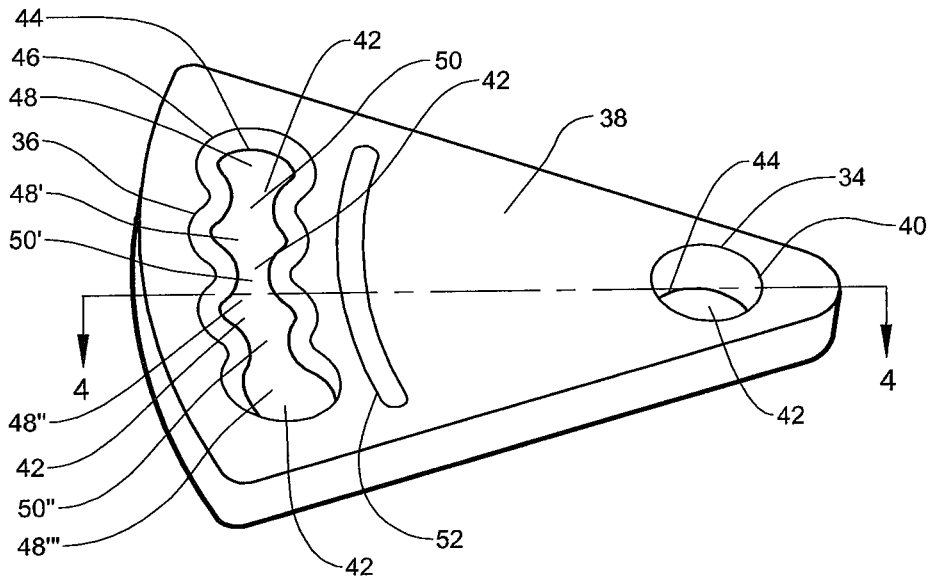
FIG. 3 shows a close-up view of an embodiment of the outer layer attachment member and the outer layer lock member.

FIG. 3 shows a close-up view of an embodiment of the outer layer attachment member, 34, and the outer layer lock member, 36, and housing 38. The outer layer attachment member, 34, includes an outer layer structure, 40, which may be either a protrusion or a socket In FIG. 3, the outer layer structure, 40, is a socket, 42, formed into the housing 38, and the socket, 42, has a certain depth. The outer layer attachment member, 34, and in this embodiment, the socket, 40, further contains a lip, 44, which together with the sun visor attachment member (see FIG. 4, at 54), or specifically the sun visor attachment structure (see FIG. 4 at 54), forms a snap fit fastener. The outer layer attachment member, 34, engages with the sun visor attachment member (see FIG. 4 at 54) to also form a fulcrum (see FIG. 5 at 68), around which the sun visor (see FIG. 1 at 20) rotates up and down.

In this embodiment, the outer layer attachment member, 34, and the outer layer lock member, 36, are integrally-formed in a housing, 38, which is typically formed of a single piece of plastic, resin or metal. Such a construction method improves manufacturing efficiency, and may also help to keep manufacturing tolerances between the sun visor and the outer layer more consistent.

In FIG. 3, the outer layer lock member, 36, includes an outer layer structure, 46, that contains a socket, 42, which is shaped such that the socket, 42, contains four fixed position locations, 48, 48', 48", and 48". In an alternate way of looking at it, in this embodiment each of the four fixed position locations, 48, is essentially a socket, 42, where adjacent sockets, 42, are connected together by a passage, 50. When a sun visor (see FIG. 1 at 20), is respectively attached thereto, then the sun visor will be releasably locked into one of four fixed positions. More specifically, in such an embodiment, the sun visor lock member (see FIG. 4 at 60), and particularly the sun visor structure (see FIG. 4 at 56), engages into the fixed position location, 48, the visor may rotate by rotating the sun visor lock member (see FIG. 4 at 60) and/or the sun visor structure (see FIG. 4 at 56), downwards through passage, 50, into fixed position location 48'. Similarly, the sun visor may be further rotated downwards by moving the sun visor lock member (see FIG. 4 at 60) and/or the sun visor structure (see FIG. 4 at 56), through passage 50' to fixed position 48", and through passage 50" to fixed position location 48'". One skilled in the art understands that further modifications to such a structure are possible and even contemplated without departing from the scope of this invention.

At each fixed position location, 48, the sun visor, 20, is in a fixed state, meaning that the visor will not move to an adjacent fixed position location without specific adjustment by the user. In the embodiment of FIG. 3, this may be achieved by, for example, making the width of the passage slightly smaller than the corresponding width of the sun visor lock member (see FIG. 4 at 60) such that the sun visor lock member (see FIG. 4 at 60) and/or the sun visor structure (see FIG. 4 at 56) will not move through any of the passages, 50, due to its own weight, or until a predetermined, intentional force is applied.

As one skilled in the art would understand an outer layer lock member, 36, could be formed with any number of such fixed position locations, as desired. Furthermore, such an outer layer lock member, 36, could be formed with such fixed position locations positioned such that the angles between such fixed positions are regular or varied, as desired.

The outer layer lock member, 36, also contains a lip, 44, similar to that of the outer layer attachment member, 34. The lip, 44, of the outer layer lock member, 36, engages the sun visor lock member (see FIG. 4 at 60) to form a snap fit fastener. In order for the sun visor lock member (see FIG. 4 at 60) and/or the sun visor structure (see FIG. 4 at 56) to move correctly through the passages, 50, the housing, 38 in FIG. 3 contains a flexibility channel, 52, in the housing, 38, which is adjacent to the outer layer attachment member, 34. The flexibility channel, 52, allows the lip, 44, of the socket, 42, and lip, 44, of the passages, 50, to flex slightly when the sun visor lock member (see FIG. 4 at 60) and/or the sun visor structure (see FIG. 4 at 56) passes by. Alternatively, the sun visor lock member (see FIG. 4 at 60) and/or the sun visor structure (see FIG. 4 at 56) could be designed to compress; or slightly compress, so as to allow them to pass through the passages, 50. The flexibility channel, 52, also may flex when the sun visor lock member (see FIG. 4 at 60) and/or the sun visor structure (see FIG. 4 at 56) is engaged with the outer layer lock member, so as to allow a snap fit fastener to be formed.

Figure 4:
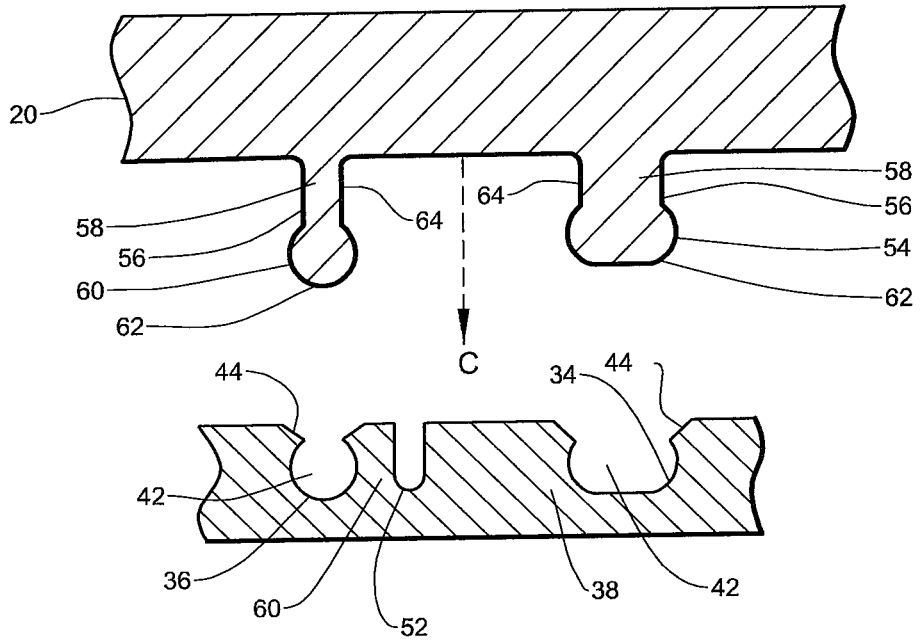
FIG. 4 shows a cut-away side view of an embodiment of the outer layer attachment member and the outer layer lock member as seen along line 4-4 of FIG. 3, along with a sun visor attachment member and a sun visor lock member.

FIG. 4 shows a cut-away side view of an embodiment of the outer layer attachment member, 34, and the outer layer lock member, 36, as seen along line 4-4 of FIG. 3, along with a sun visor attachment member, 54. The sun visor attachment member, 54, contains a sun visor structure, 56, which in turn includes a protrusion, 58 which juts out from the sun visor, 20. When the sun visor, 20, is moved in the direction of arrow, C, the sun visor, 20, and the housing, 38, come together such that the sun visor attachment member, 54, engages with the outer layer attachment member, 34, to form a snap fit fastener. More specifically, in this embodiment the outer layer attachment member, 34, is an outer layer structure, 40, containing a socket, 42, that engages the sun visor attachment member, 54. The sun visor attachment member, 54, contains a sun visor structure, 56, that in turn contains a protrusion, 58, that engages the socket, 42, to form a fulcrum (see FIG. 5, at 68), around which the sun visor may rotate.

Similarly, when the sun visor is moved in the direction of arrow, C, the sun visor, 20, and the housing, 38, come together such that the sun visor lock member, 60, engages with the outer layer lock member, 36, to form a snap fit fastener. More specifically, in this embodiment the outer layer lock member, 36, is an outer layer structure, 40, containing a socket, 42, that engages the sun visor lock member, 60. The sun visor lock member, 60, contains a sun visor structure, 56, that in turn contains a protrusion, 58, that engages the socket, 42, to allow the sun visor, 20, to be releasably locked into one of a plurality of fixed positions.

Figure 5:
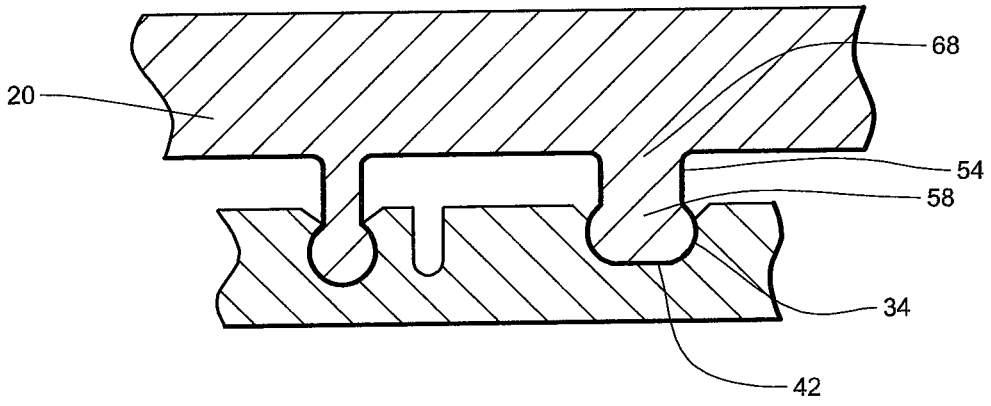
FIG. 5 shows the cut-away side view of FIG. 4, when the outer layer attachment member forms a snap fit fastener with the sun visor attachment member.

In the embodiment of FIG. 4, the outer layer attachment member, 34, and the sun visor attachment member, 54, rotatably engage via a snap fit fastener to form a fulcrum (see FIG. 5 at 68). Similarly, the outer layer lock member, 36, and the sun visor lock member, 60, engage via a snap fit fastener so that the sun visor, 20, may be releasably locked into one of a plurality of fixed positions. In practice, one skilled in the art understands that the protrusion will typically contain the pair of, for example, a larger portion and a smaller portion, a wider portion and a thinner portion, etc. In FIG. 4, the protrusion, 58, has a bulbous head, 62, and a thinner shaft, 64. When the protrusion, 58, is engaged with the socket, 42, the bulbous head, 62, pushes past the lip, 44, by slightly flexing and/or deforming them. Once the bulbous head, 62, is past the lip, 44, then the lip, 44, regains is normal shape, effectively locking the bulbous head, 62, into the socket, 42, and holding the thinner shaft, 64, in place. Similarly with the outer layer lock member, 36, the protrusion, 58, engages with the socket, 42, and deforms the lip, 44, and the flexible wall, 66, between the socket, 42, and the flexibility channel, 52.

Such snap fit fasteners, their construction, and the materials therefor are well-known in the art; in an embodiment herein the snap fit fastener is selected from the group consisting of a cylindrical-type snap fit and a spherical-type snap fit. While a cantilever beam snap fit may be technically possible, such a shape typically makes it difficult for the outer layer attachment member to rotatably engage the sun visor attachment member. Furthermore, the structural elements of each side of the snap fit fastener may be formed integrally as a single piece or may be formed individually and subsequently combined, as is known in the art.

Without intending to be limited by theory, it is believed that the use of a snap fit fastener in the present invention possesses many advantages as compared to a screw, bolt, or other fastening method. Specifically, such a snap fit fastener is significantly easier and faster to assemble than other fastening methods. Thus, manufacturing speeds are increased, while production errors and manufacturing complexity are decreased. Further, it is recognized that in many cases the sun visor may become damaged while the remainder of the helmet remains undamaged. In such cases, the user may wish to quickly and easily replace the sun visor with a replacement. Such a snap fit fastener makes such a replacement by the user easy on the road, without the need for tools. In another instance, the user may wish to have different types of sun visors (e.g., different shapes, different tints, opaque/translucent, different colors, etc.) and thus they may wish to often replace or change the sun visor while utilizing the same helmet. The improved bicycle helmet herein provides such advantages.

One skilled in the art will understand that each of the outer layer attachment member and the outer lock member may contain an outer layer structure. Each outer layer structure may be selected from a protrusion, a socket, and a combination thereof, as desired by the designer. However, in such a case, the corresponding sun visor attachment member and the sun visor lock member should contain a complementary sun visor structure selected from a protrusion, a socket, and a combination thereof. Where the outer layer structure contains a protrusion, then the corresponding sun visor structure should be a socket, and visa versa. Where the outer layer structure contains both a protrusion and a socket, then the corresponding sun visor structure should contain a socket and a protrusion, respectively, that engages the complementary outer layer structure. Therefore, one skilled in the art will understand that various similar but related, or even opposite embodiments are contemplated herein. In an embodiment herein the sun visor attachment member includes a sun visor structure selected from a protrusion and a socket. In an embodiment herein, the sun visor lock member includes a sun visor structure selected from a protrusion and a socket. In an embodiment herein, the outer layer attachment member includes an outer layer structure selected from a protrusion and a socket. In an embodiment herein, the outer layer lock member includes an outer layer structure selected from a protrusion and a socket.

Furthermore, for the ease of manufacturing, and to reduce raw material needs, in an embodiment herein the sun visor lock member is proximal to the sun visor attachment member and the outer layer lock member is correspondingly proximal to the outer layer attachment member. In such a case, the outer layer lock member and the outer layer attachment member may be combined into a single housing. In an embodiment herein, the housing is symmetrical with respect to the outer layer lock member and the outer layer attachment member; or the housing is symmetrical; such as along line 4-4 in FIG. 3, such that the same housing may be used on both sides of the helmet. In a case where the housing is symmetrical with respect to the outer layer lock member and the outer layer attachment member, the housing may contain other non-symmetrical portions which do not affect the position and function of the outer layer lock member and the outer layer attachment member. See, for example, FIG. 6 at 70.

In an embodiment herein, the outer layer attachment member contains a plane of symmetry as shown by the plane represented by line 4-4 shown in FIG. 3. In an embodiment herein, the sun visor attachment member contains a plane of symmetry. In an embodiment herein, both the outer layer attachment member and the sun visor attachment member contain planes of symmetry; or the same plane of symmetry. Without intending to be limited by theory, it is believed that such a plane of symmetry allows the sun visor to rotate more easily.

FIG. 5 shows the cut-away side view of FIG. 4, when the outer layer attachment member, 34, engages with the sun visor attachment member, 54 via a snap fit fastener so as to form the protrusion, 58, into a fulcrum, 68 about which the sun visor, 20, may rotate.

Figure 6:
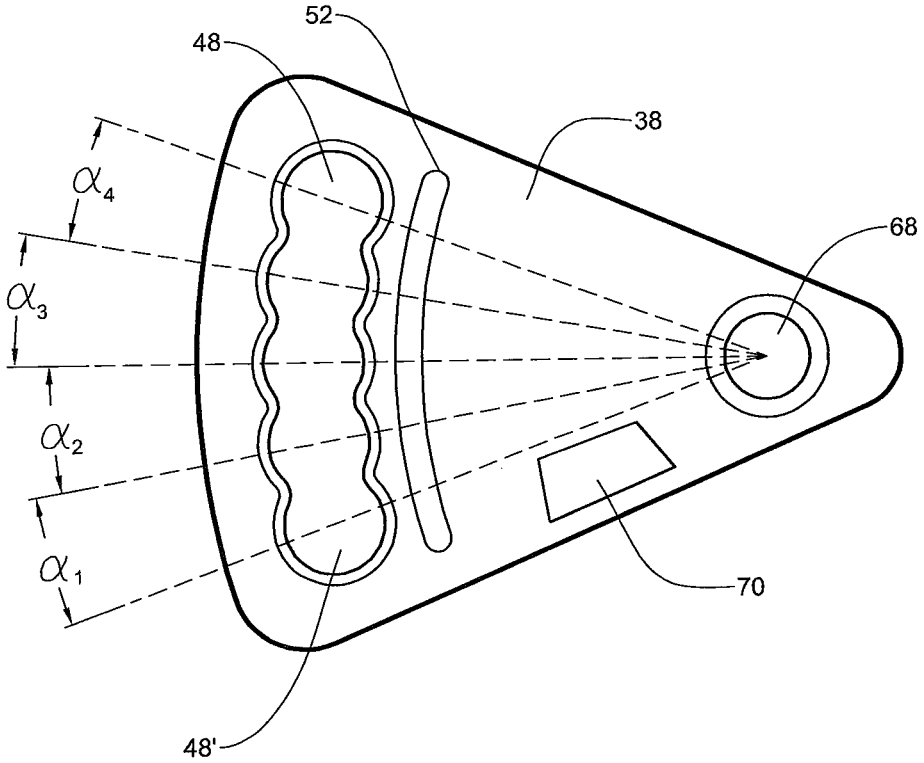
FIG. 6 shows a top view of an embodiment of a housing, indicating the angles of rotation available.

FIG. 6 shows a top view of an embodiment of a housing, indicating the angles of rotation available. The maximum sun visor (see FIG. 1 at 20) rotation possible is a 360° rotation. However, in FIG. 6, a housing, 38, is shown which has five fixed position locations, 48, which define therebetween, four standard angles, $\alpha_1$, $\alpha_2$, $\alpha_3$, and $\alpha_4$, which are intended to indicate four angles of rotation. In the embodiment of FIG. 6, the standard angles, $\alpha_1$, $\alpha_2$, $\alpha_3$, and $\alpha_4$ are all intended to be equal, although one skilled in the art understands that in another embodiment the angles may also be different, as desired. In the case of a sun visor with little vertical flexibility, the angles provided in the fixed position locations will correspond directly to the angles at which the sun visor (FIG. 1 at 20) rotate about the helmet (FIG. 1 at 10).

In an embodiment herein the maximum sun visor rotation, as measured from a fixed position location, 48, to the most distal fixed position location, 48' with respect to the fulcrum, 68, is from about 3° to about 90°; or from about 5° to about 50°; or from about 6° to about 45°; or from about 7° to about 25°. Without intending to be limited by theory, it is believed that angles that are too large may cause increased air resistance against the sun visor, which is undesirable, whereas an angle which is too small may not be sufficient adjustment for the user to effectively block the sun at different times and angles.

An optional positioning tab, 70, also helps to align the housing, 38, within a mould, and/or to help prevent slippage of the housing during the manufacturing process. Such a positioning tab may be, for example, an indentation, or a protrusion as desired. In an embodiment herein, the outer layer attachment member; or the outer layer lock member; or the outer layer attachment member and the outer layer lock member; or the housing, is embedded in the outer layer. Such an embedding may be, by, for example, placing the outer layer attachment member; or the outer layer lock member; or the outer layer attachment member and the outer layer lock member; or the housing into the mould during the production process, and then forming the outer layer around it. Alternatively, the outer layer attachment member; or the outer layer lock member; or the outer layer attachment member and the outer layer lock member; or the housing may be embedded into the outer layer after the outer layer is made by, for example adding it to a predetermined spot in the outer layer. Without intending to be limited by theory, it is believed that such an embedded outer layer attachment member; or the outer layer lock member; or the outer layer attachment member and the outer layer lock member; or the housing may reduce drag and appear more sturdy, and therefore be more desirable to a user.

Figure 7:
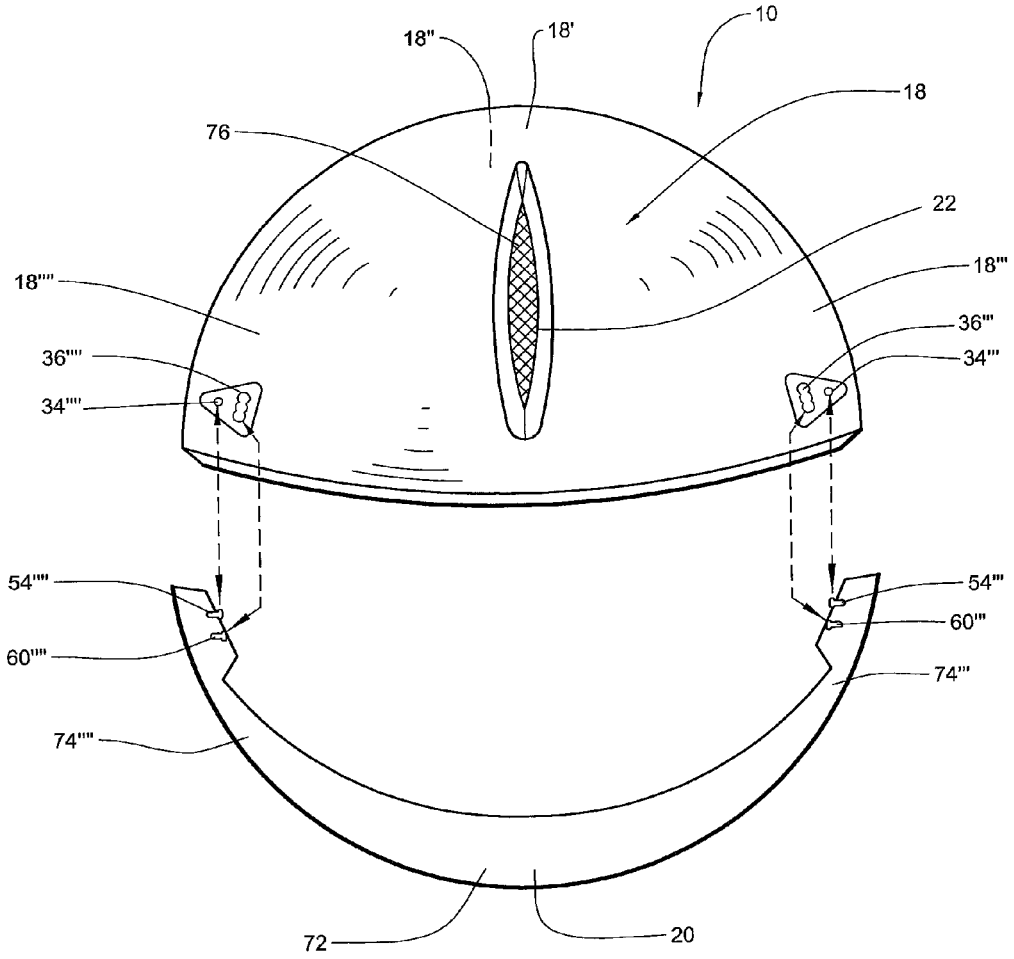
FIG. 7 shows a front exploded view of an embodiment of the helmet with the sun visor.

FIG. 7 shows a front exploded view of an embodiment of the helmet, 10, with the sun visor, 20, disconnected. The helmet, 10, in FIG. 7 is shown as if it was sitting on the head of a user, and the viewer is looking at the user's face. In FIG. 7, the helmet contains an outer layer front side, 18', and an outer layer back side, 18", opposite the outer layer front side, 18'. An outer layer left side, 18''' is operatively connected to the outer layer front side, 18', and the outer layer back side, 18". An outer layer right side, 18'''', is operatively connected to the outer layer front side, 18', and the outer layer back side, 18", and the outer layer right side, 18'''', is opposite the outer layer left side, 18'''. This numbering convention is consistently used herein with respect to FIG. 7, only. Thus, one skilled in the art understands that the outer layer front side, 18''', and the outer layer right side, 18'''' as indicated in FIG. 7 bear no orientational relationship to, for example, fixed position location, 48''', and fixed position location, 48'''', in FIG. 3.

Turning to the embodiment of FIG. 7, the outer layer attachment member, 34, has an outer layer left attachment member, 34''', and an outer layer right attachment member, 34''''. and wherein the outer layer, 18, further includes an outer layer front side, 18', and an outer layer back side, 18", opposite the outer layer front side, 18'. An outer layer left side, 18''' is operatively connected to the outer layer front side, 18', and the outer layer back side, 18". An outer layer right side, 18'''', is operatively connected to the outer layer front side, 18', and the outer layer back side, 18", and the outer layer right side, 18'''', is opposite the outer layer left side, 18'''.

In FIG. 7, the outer layer left side, 18''', contains an outer layer left attachment member, 34''', whereas the outer layer right side contains an outer layer right attachment member, 34''''.

The sun visor, 20, contains a shade member, 72, which is intended to cast shade over the user's eyes, and a sun visor left arm, 74''', extending from the shade member, 72. The sun visor left arm, 74''', contains a sun visor left attachment member, 54''', connected to and distal from the shade member, 72. Similarly, the sun visor, 20, contains a sun visor right arm, 74'''', extending from the shade member, 72. The sun visor right arm, 74'''', is opposite the sun visor left arm, 74''', and includes a sun visor right attachment member, 54'''', connected to and distal from the shade member, 72. When the sun visor, 20, is connected to the outer layer, 18, (see the dotted arrows) the outer layer left attachment member, 34''', rotatably engages with the sun visor left attachment member, 54''', to form a left fulcrum, and the outer layer right attachment member, 54'''', rotatably engages with the sun visor right attachment member, 34'''' to form a right fulcrum (not shown).

The sun visor left arm, 74''', also contains a sun visor left lock member, 60''', and the outer layer left side, 18''', contains a corresponding outer layer left lock member, 36'''. The sun visor right arm, 74'''', also contains a sun visor right lock member, 60'''', and the outer layer right side, 18'''', contains a corresponding outer layer right lock member, 36''''. When the sun visor, 20, is connected to the outer layer, 18, (see the dotted arrows) the sun visor left lock member, 60''', operatively engages the outer layer left lock member, 36''', to releasably lock the sun visor, 20, to allow a plurality of fixed left positions (not shown). When the sun visor, 20, is connected to the outer layer, 18, (see the dotted arrows) the sun visor right lock member, 60'''', operatively engages the outer layer right lock member, 36'''', to releasably lock the sun visor, 20, to allow a plurality of fixed right positions (not shown).

Therefore, one skilled in the art understands that in FIG. 7, the outer layer, 18, includes a pair of outer layer attachment members, 34''', 34'''', opposing each other, and the sun visor, 20, includes a pair of sun visor attachment members, 54''', 54'''', opposing each other. In this embodiment, the pair of outer layer attachment members, 34''', 34'''', rotatably engage the pair of sun visor attachment members, 54''', 54''''.

Helmet, 10, also contains a vent, 22, in which is embedded a mesh, 76. The mesh, 76, is typically a fine mesh which allows air to flow therethrough to maintain ventilation for the user's head, while simultaneously preventing debris such as insects, leaves, etc. from entering the helmet and bothering the user.

In an embodiment herein, the outer layer attachment member, the outer layer lock member, the sun visor attachment member and the sun visor lock member are independently made from a material selected from a plastic, a resin, rubber, glass, and a combination thereof.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

What is claimed is:

1. An improved bicycle helmet comprising:

A. an inner layer having a concave shape;

B. an outer layer having a convex shape, the outer layer covering the inner layer, the outer layer comprising:

i. an outer layer attachment member; and ii. an outer layer lock member; and

C. a sun visor comprising:

i. a shade member;

ii. a sun visor attachment member connected to and distal to the shade member, and wherein the sun visor attachment member is adapted to rotatably engage with the outer layer attachment member to form a fulcrum; and iii. a sun visor lock member adapted to operatively engage to the outer layer lock member so as to releasably lock the sun visor into a fixed position, and wherein the sun visor lock member and the outer layer lock member operatively engage so as to allow the sun visor to be releasably locked into one of a plurality of fixed positions, wherein in one of said plurality of fixed positions, said sun visor extends outwardly from said helmet to a position adopted to cast shade over a wearer's eyes; and wherein the sun visor attachment member and the outer layer attachment member rotatably engage via a snap fit fastener.

2. The improved bicycle helmet according to claim 1 wherein the plurality of fixed positions is from 2 fixed positions to 6 fixed positions.

3. The improved bicycle helmet according to claim 1 wherein the sun visor attachment member comprises a sun visor structure selected from the group consisting of a protrusion and a socket and wherein said visor snap fits to said outer layer attachment member.

4. The improved bicycle helmet according to claim 3 wherein the sun visor lock member comprises a sun visor structure selected from the group consisting of a protrusion and a socket and wherein said visor lock member snap fits to said outer layer lock member.

5. The improved bicycle helmet according to claim 4 wherein the outer layer attachment member comprises an outer layer structure selected from the group consisting of a protrusion and a socket.

6. The improved bicycle helmet according to claim 5 wherein the outer layer lock member comprises an outer layer structure selected from the group consisting of a protrusion and a socket.

7. The improved bicycle helmet according to claim 1 wherein the sun visor lock member is proximal to the sun visor attachment member and wherein the outer layer lock member is correspondingly proximal to the outer layer attachment member.

8. The improved bicycle helmet according to claim 1 wherein the outer layer comprises a pair of outer layer attachment members opposing each other, and wherein the sun visor comprises a pair of sun visor attachment members opposing each other, and wherein the pair of outer layer attachment members rotatably engage the pair of sun visor attachment members.

9. The improved bicycle helmet according to claim 1 wherein the outer layer comprises an outer layer left attachment member and an outer layer right attachment member, and wherein the outer layer further comprises:

iii. an outer layer front side;

iv. an outer layer back side opposite the outer layer front side;

v. an outer layer left side operatively connected to the outer layer front side and the outer layer back side, the outer layer left side comprising the outer layer left attachment member;

vi. an outer layer right side operatively connected to the outer layer front side and the outer layer back side, the outer layer right side opposite the outer layer left side, and the outer layer right side comprising the outer layer right attachment member, and wherein the sun visor comprises a sun visor left attachment member and a sun visor right attachment member, and wherein the sun visor further comprises:

iv. a sun visor left arm extending from the shade member, the sun visor left arm comprising the sun visor left attachment member connected to and distal from the shade member; and v. a sun visor right arm extending from the shade member, the sun visor right arm opposite the sun visor left arm, the sun visor right arm comprising the sun visor right attachment member connected to and distal from the shade member, and wherein the outer layer left attachment member rotatably engages with the sun visor left attachment member, and wherein the outer layer right attachment member rotatably engages with the sun visor right attachment member.

10. The improved bicycle helmet according to claim 1, wherein the outer layer attachment member comprises a plane of symmetry.

11. The improved bicycle helmet according to claim 1, where in the snap fit fastener is selected from the group consisting of a cylindrical type snap fit fastener and a spherical type snap fit fastener.

12. The improved bicycle helmet according to claim 1, wherein the outer layer attachment member is embedded in the outer layer.

13. The improved bicycle helmet according to claim 1 wherein the outer layer attachment member, the outer layer lock member, the sun visor attachment member and the sun visor lock member are independently made from a material selected from a plastic, a resin, rubber, glass, and a combination thereof.

14. The improved bicycle helmet according to claim 1, further comprising a housing, and wherein the housing comprises the outer layer lock member and the outer layer attachment member.

15. The improved bicycle helmet according to claim 1, wherein the outer layer attachment member and the outer layer lock member are integrally-formed in a housing.

16. The improved bicycle helmet according to claim 1 wherein said sun visor is opaque.

17. The improved bicycle helmet according to claim 1 wherein the helmet is not a full face helmet.

18. An improved bicycle helmet comprising:

A. an inner layer having a concave shape; and

B. an outer layer having a convex shape, the outer layer covering the inner layer, the outer layer comprising:

i. an outer layer attachment member comprising an outer layer left attachment member and an outer layer right attachment member;

ii. an outer layer front side;

iii. an outer layer back side opposite the outer layer front side;

iv. an outer layer left side operatively connected to the outer layer front side and the outer layer back side, the outer layer left side comprising an outer layer left attachment member comprising an outer layer structure;

v. an outer layer right side operatively connected to the outer layer front side and the outer layer back side, the outer layer right side opposite the outer layer left side, and the outer layer right side comprising an outer layer right attachment member comprising an outer layer structure;

vi. an outer layer lock member comprising:

(1) an outer layer left lock member proximal to the outer layer left attachment member, the outer layer left lock member comprising an outer layer structure, and (2) an outer layer right lock member proximal to the outer layer right attachment member, the outer layer right lock member comprising an outer layer structure, wherein the outer layer structure comprises a socket, and C. a sun visor comprising:

i. a shade member;

ii. a sun visor left arm extending from the shade member, the sun visor left arm comprising:

(1) a sun visor left attachment member connected to and distal to the shade member, the sun visor left attachment member adapted to rotatably engage with the outer layer left attachment member to form a fulcrum, the sun visor left attachment member comprising a sun visor structure; and (2) a sun visor left lock member proximal to the sun visor left attachment member, the sun visor left lock member adapted to operatively engage the outer layer left lock member so as to releasably lock the sun visor into from 2 fixed positions to 6 fixed positions, the sun visor left lock member comprising a sun visor structure, and iii. a sun visor right arm extending from the shade member, the sun visor right arm opposite the sun visor left arm, the sun visor right arm comprising:

(1) a sun visor right attachment member connected to and distal to the shade member, the sun visor right attachment member adapted to rotatably engage with the outer layer right attachment member to form a fulcrum, the sun visor right attachment member comprising a sun visor structure; and (2) a sun visor right lock member proximal to the sun visor right attachment member, the sun visor right lock member adapted to operatively engage the outer layer right lock member so as to releasably lock the sun visor into from 2 fixed positions to 6 fixed positions, the sun visor right lock member comprising a sun visor structure, wherein said sun visor is adapted to extend outwardly from said helmet and provide shade to a wearer; and wherein the sun visor structure comprises a protrusion, and wherein the protrusion engages the corresponding socket of the outer layer structure to form a snap fit fastener.

19. The improved bicycle helmet according to claim 18 wherein said sun visor is opaque.

20. The improved bicycle helmet according to claim 18 wherein said helmet is not a full face helmet.

* * * * *